US005390793A

United States Patent [19]

Kausch et al.

[11] Patent Number: 5,390,793

[45] Date of Patent: Feb. 21, 1995

[54] CARRIER FOR A FILM PACKAGE

[75] Inventors: Thomas J. Kausch; James E. Przybylowicz, both of Rochester, N.Y.

[73] Assignee: Eastman Kodak Company, Rochester, N.Y.

[21] Appl. No.: 249,411

[22] Filed: May 26, 1994

[51] Int. Cl.[6] ..... B65D 85/62

[52] U.S. Cl. ..... 206/455; 354/275

[58] Field of Search ..... 206/454, 455, 456, 449; 378/182, 188; 354/275

[56] References Cited

U.S. PATENT DOCUMENTS 3,946,868 3/1976 Rutter ..... 206/455
4,093,069 6/1978 Smolderen ..... 206/455
4,915,229 4/1990 Yamada et al. ..... 206/455
5,123,536 6/1992 Di Pietro ..... 354/275 X

*Primary Examiner*—Jacob K. Ackun, Jr.
*Attorney, Agent, or Firm*—Dana M. Schmidt

[57] ABSTRACT

A film package in which the carrier for a stack of film sheets inside a light-tight wrapper is improved to provide a rigid corner that resists being pulled into the printer when the wrapper is removed. The corner is achieved by a construction featuring a bottom panel, first and second side panels hingedly and integrally attached to adjacent side edges of the bottom panel, and a top panel extending from an edge of one of the side panels and permanently secured to the other of the side panels to define a rigid exterior corner, the top panel having dimensions such that it leaves exposed a portion of any film sheet and the bottom panel under the top panel.

4 Claims, 4 Drawing Sheets

CARRIER FOR A FILM PACKAGE

FIELD OF THE INVENTION

This invention relates to a film package of film sheets automatically unloaded from a light-tight wrapper in a printer. More specifically, it relates to an improvement in the carrier used in such a package.

BACKGROUND OF THE INVENTION

Film packages are conventionally used to supply stacks of photographic film sheets to printers. Such packages comprise a carrier of heavy-duty paper or cardboard partially enclosing the stack, and a light-tight flexible wrapper enclosing the carrier and the stock, as described for example in U.S. Pat. No. 4,915,229. One end of such a wrapper is automatically pulled off the stack within the confines of the printer to leave the stack of film accessible for pulling off individual sheets from the stack.

The difficulty with conventional film packages such as the type described in the '229 patent is that the carrier has not been sufficiently rigid to withstand the rigors of the wrapper removal within the printer. Because the top panel of the carrier is not secured all the way around one exterior corner, but is free to hinge upwardly, the entire carrier is subject to collapsing or bending sufficiently when the wrapper is pulled off, as to cause the carrier to follow the carrier into the printer sufficiently to cause a jam. At the same time, however, it has been useful to have at least one part of the cover of the carrier flex away when a film sheet is pulled off the stack. These tend to be conflicting requirements.

Hence, prior to this invention there has been a need to provide a film package wherein the carrier has sufficient rigidity, especially at the corner adjacent to the exit slot for the wrapper, to resist the tendency to follow the wrapper into the printer.

SUMMARY OF THE INVENTION

We have developed a film package that solves the above noted need.

More specifically, there is provided a film package for delivery of film sheets as a stack, comprising a stack of photographic film sheets, a protective carrier partially surrounding the stock, and a light-tight flexible wrapping around the carrier and the stack. The package is improved in that the carrier comprises a bottom panel, first and second side panels hingedly and integrally attached to adjacent side edges of the bottom panel, and a top panel extending from an edge of one of the side panels and permanently secured to the other of the side panels to define a secured exterior corner, the top panel having dimensions such that it leaves exposed a portion of any film sheets and the bottom panel under the top panel, so that the permanent securing of the top panel to the other side panel rigidifies the carrier sufficiently to reduce collapsing of the carrier during removal of the flexible wrapping.

Accordingly, it is an advantageous feature of the invention that a film package is provided with a carrier for the stack that resists the removal forces operating on the surrounding flexible wrapper so as to reduce the likelihood of jamming.

Other advantageous features will become apparent upon reference to the following "Detailed Description" when read in light of the attached drawings.

DESCRIPTION OF THE PREFERRED EMBODIMENTS

The invention is hereinafter described with respect to the preferred embodiments, wherein the carrier of the package has panels of certain preferred dimensions and shapes, and is assembled through the use of adhesive. In addition, the invention is useful regardless of the dimensions and shapes of the panels and regardless whether they are assembled using adhesive, provided however that one of the exterior corners of the package adjacent to the wrapper remover mechanism is a secured corner.

Figure 1:
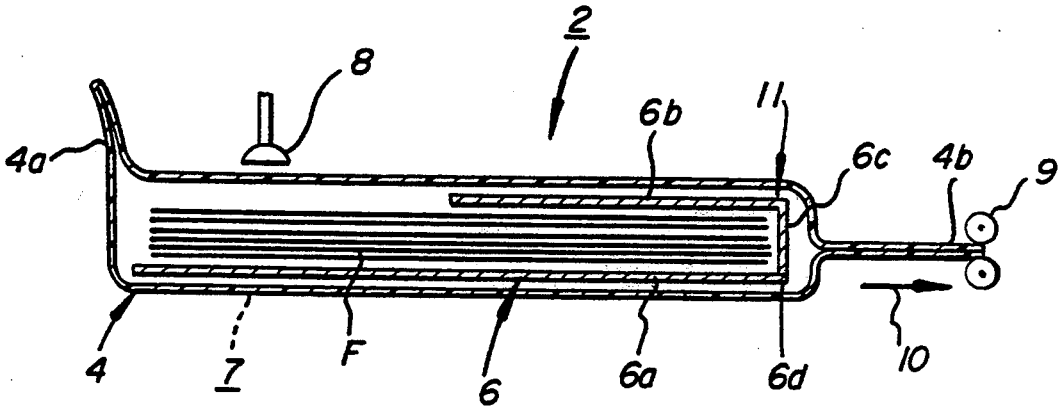
FIG. 1 PRIOR ART
FIG. 1 is a partially schematic view of a film package of the prior art in place in a printer, the package being shown in section.

As shown in FIG. 1, a printer (not shown) conventionally receives a package 2 of film sheets with the flexible wrapper 4 totally enclosing a carrier 6 and a stack of photographic film sheets F partially enclosed by the carrier 6. Two opposite ends 4*a* and 4*b* of the wrapper are disposed so that end 4*a* can be cut, and end 4*b* grasped by rollers 9 of the printer to automatically remove the wrapper, arrow 10, leaving behind carrier 6 and the stack of sheets F. As is apparent, top panel 6*b* of carrier 6 does not extend all the way over the entire stack of sheets, and where it is not present, a suction device 8 conventionally lowers into contact with the stack to remove the sheets one at a time.

The difficulty has been that top panel 6*b* has been integrally connected to a side panel 6*c* which, in the case of carriers such as are shown in the '229 patent, is not secured to the bottom panel 6*a* of the carrier, anywhere. That is, panel 6*c* is not joined to edge 6*d* of panel 6*a*. As a result, corner 11 is not rigid but subject to collapsing under the influence of the friction created by the removal of wrapper 4 by rollers 9.

Figure 2:
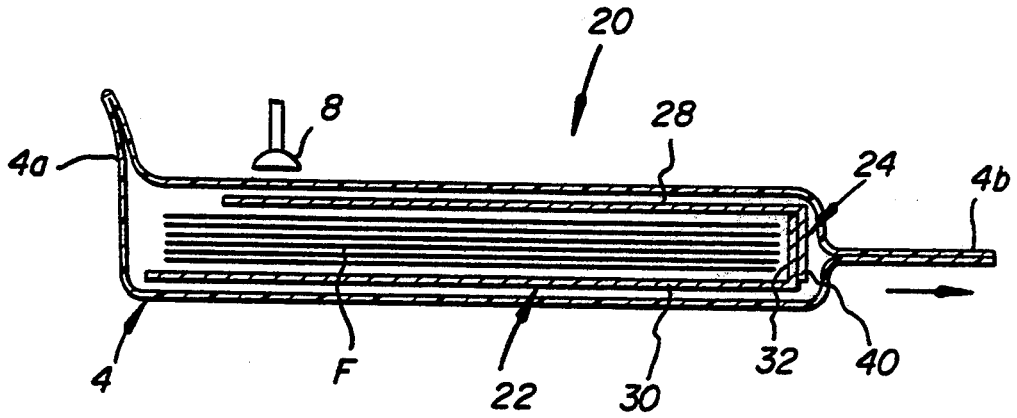
FIG. 2 is a view similar to that of FIG. 1, but of the package of the invention.

In accordance with the invention, FIG. 2, a package 20 is provided wherein carrier 22 is improved to rigidify the corner 24 and hence resist the tendency of the carrier to be pulled into the printer. (The stack of film sheets, wrapper, and printer construction is substantially as described for FIG. 1). That is, side panel 40 extending from top panel 28 is permanently secured to the bottom panel 30, most preferably by being permanently secured to a side panel 32 integrally extending from bottom panel 30. As used herein, "permanently secured" means, in a manner, such as by the use of adhesive, preventing separation of the two during normal use, without damaging the carrier panels by tearing or the like. It does not mean, of course, that the carrier panels cannot be deliberately torn apart with effort, given that the material of the carrier is relatively weak in tear strength.

Figure 3:
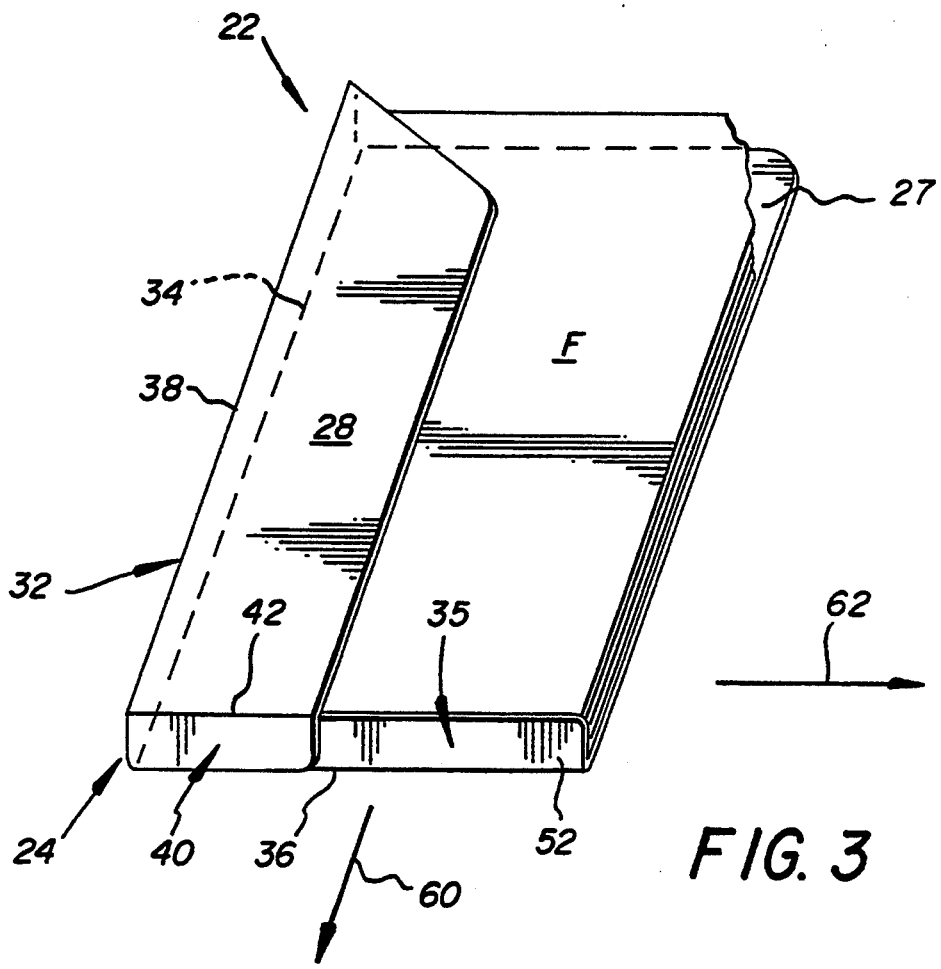
FIG. 3 is an isometric view of a film package of the invention with the flexible, light-tight wrapper removed and a corner of the stack partially broken away.
Figure 4:
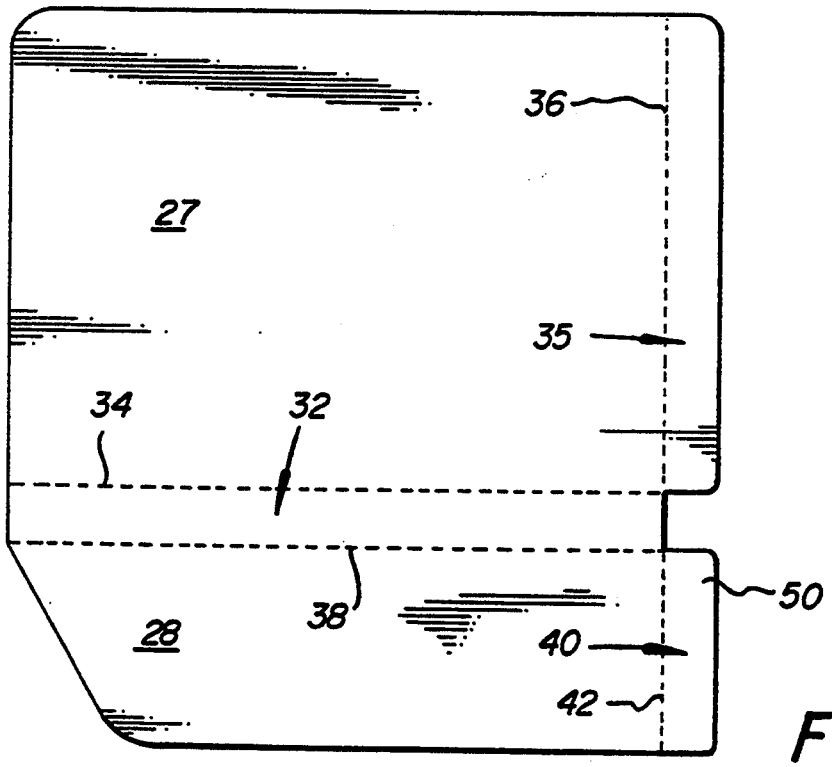
FIG. 4 is a plan view of the lay-out of the carrier of the package before it is folded and secured to itself.

More specifically, referring to FIGS. 3 and 4, the package carrier of the invention comprises, as partially noted above, a bottom panel 27, a first side panel 32 hingedly extending from one edge 34 of panel 27, FIGS. 3 and 4, a second side panel 35 hingedly extending from edge 36 of bottom panel 27 adjacent to edge 34, top panel 28 joined to and hingedly extending from an edge 38 of side panel 32, and a side panel 40 hingedly extending from a side edge 42 of top panel 28 adjacent to side edge 38. To anchor top panel 28 to side panel 35 at and adjacent to exterior corner 24, means such as an adhesive are disposed between the undersurface 50 of side panel 40, FIG. 4, and the exterior surface 52 of side panel 35, FIG. 3. Any such adhesive can be used, for example, a hot-melt or liquid adhesive, or adhesive tape. Highly preferred is a glue strip on surface 50 of heat-activated adhesive such as that available from Eastman Chemical under the trademark "Eastobond".

Alternatively, panels 35 and 40 could be stapled together.

With side panel 40 so permanently secured to side panel 35, corner 24 is rigid and permanent, thus preventing the carrier box shape so created from being collapsed due to the pulling off of the light-tight wrapper by the printer in the direction of arrow 60.

The film sheets F are preferably removed one at a time in the direction of arrow 62.

It is not essential that the carrier be in only one piece. Instead, FIGS. 5–7, it can comprise two portions that nest together, either with or without adhesive between the two portions to permanently secure them together. Parts similar to those previously described bear the same reference numeral to which the distinguishing suffix "A" has been appended.

Figure 5:
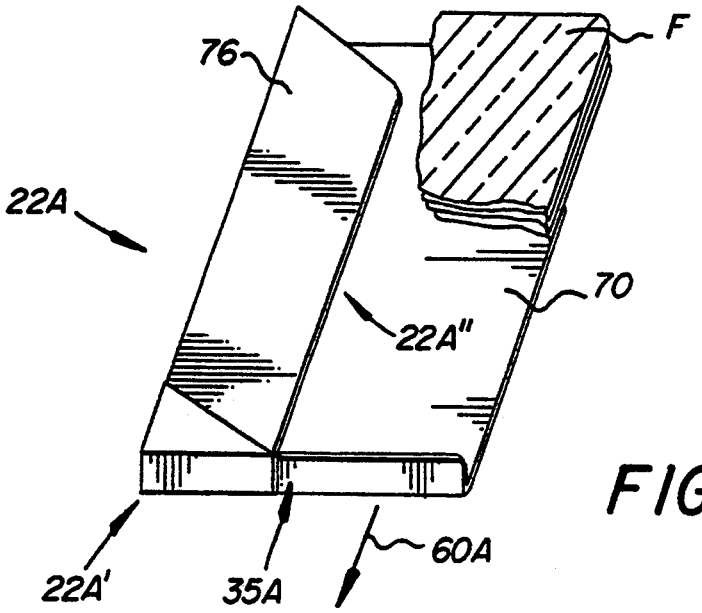
FIG. 5 is an isometric view similar to that of FIG. 3, but of an alternative embodiment wherein the carrier has two portions.
Figure 6:
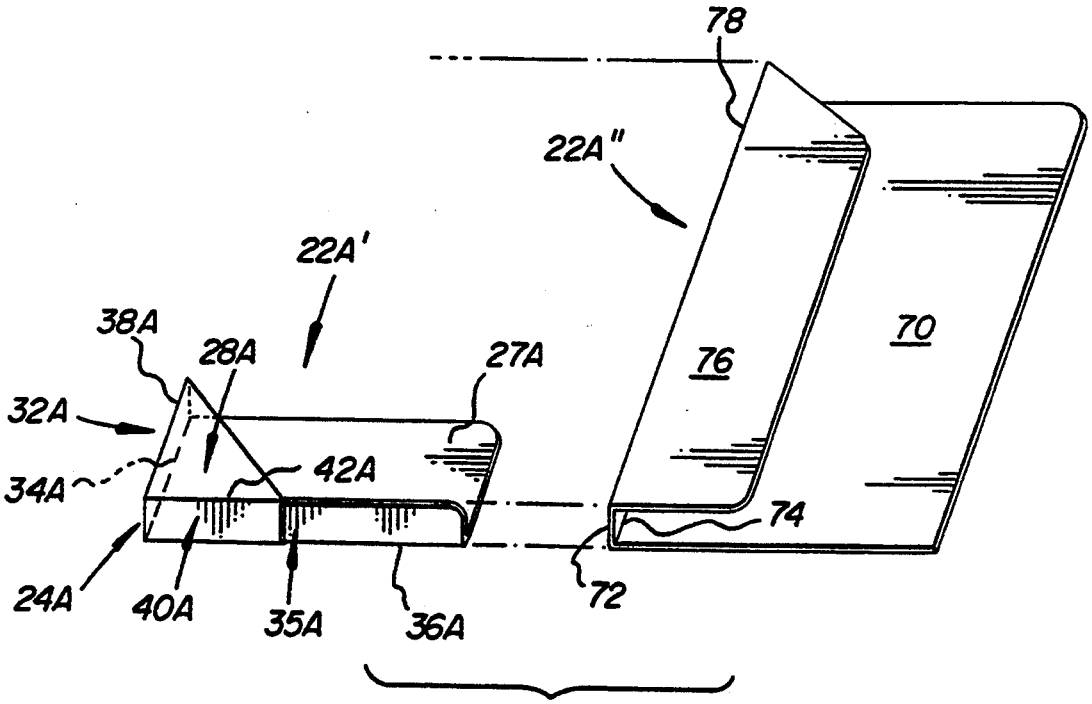
FIG. 6 is an exploded isometric view showing the two portions of the carrier separately.

Thus, FIG. 5, carrier 22A comprises a first portion 22A', FIG. 6, and a second portion 22A". Portion 22A', like in the previous embodiment, comprises a bottom panel 27A having two adjacent side edges 34A and 36A, a side panel 32A hingedly extending from side edge 34A and another side panel 35A hingedly extending from side edge 36A, and a top 28A panel hingedly extending from a side edge 38A of side panel 32A opposite to side edge 34A. Top panel 28A also has a side panel 40A hingedly extending from a side edge 42A, and it is this side panel 40A that is permanently secured to side panel 35A, using means such as the adhesive discussed in the previous embodiment.

However, in this embodiment bottom panel 27A is not as large in surface area as the undersurface area of the stack F of film sheets, FIG. 5. Accordingly, portion 22A" is provided, FIG. 6, to fit either temporarily or permanently within corner 24A of portion 22A'. Such second portion comprises a bottom panel 70 of approximately the same surface area as stack F of the film sheets, FIG. 5, a side panel 72, FIG. 6, hingedly extending from side edge 74 of panel 70, and a top panel 76 hingedly extending from side edge 78 of panel 72 opposite to side edge 74. Hence, panels 70 and 76 are larger in surface area than panels 27A and 28A, respectively.

Figure 7:
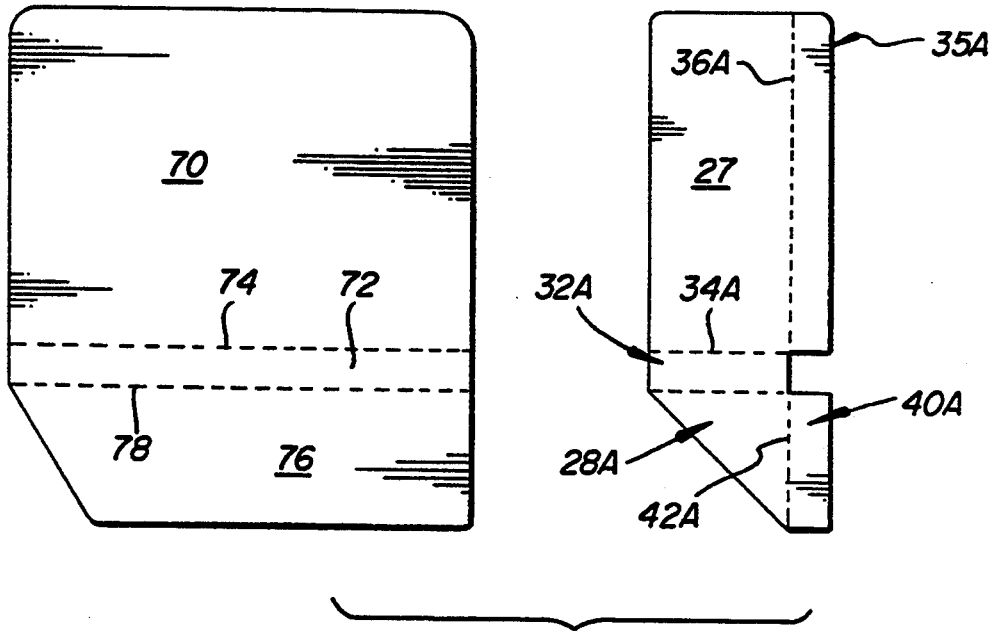
FIG. 7 is a plan view similar to that of FIG. 4 but of the embodiment of FIG. 6.

The laid-out shapes of portions 22A' and 22A" are shown in FIG. 7.

Figure 8:
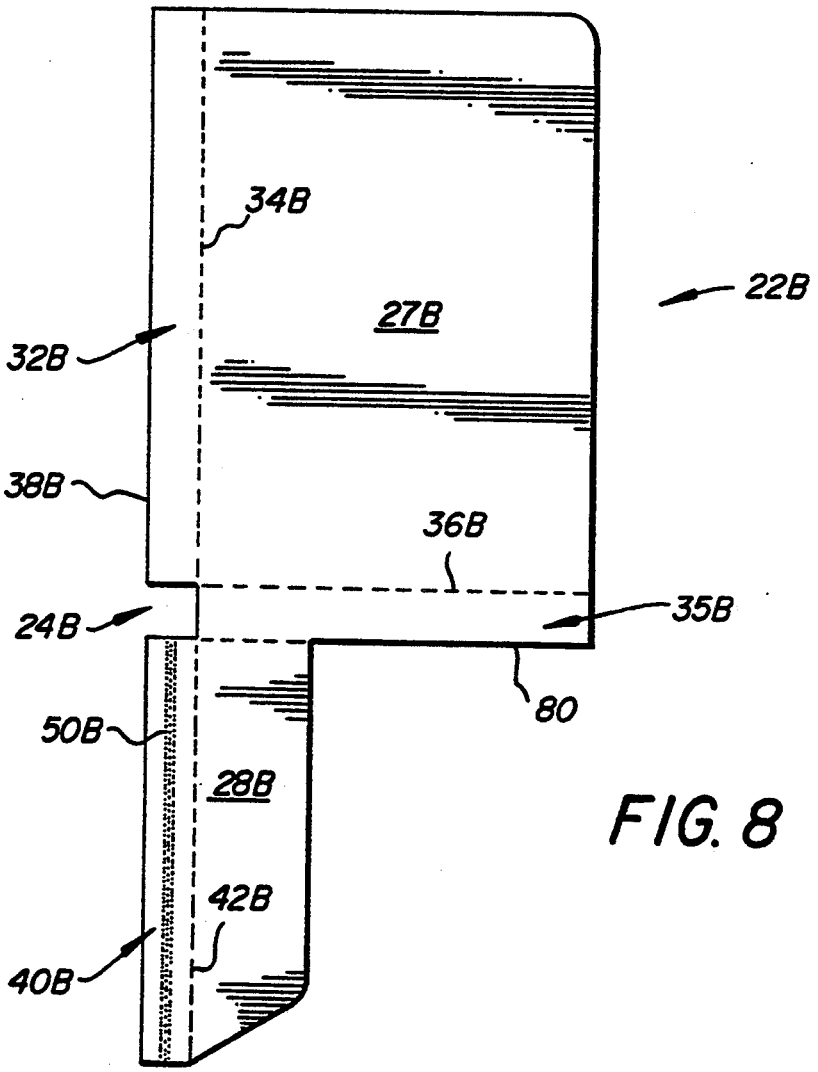
FIG. 8 is a plan view of the carrier, similar to that of FIG. 4 but of still another embodiment.

Alternatively, the top panel of the rigid corner need not extend from the larger side edge of the bottom panel. Instead, it can hingedly extend from the shorter side edge, FIG. 8. Parts similar to those previously described bear the same reference numeral to which the distinguishing suffix "B" is appended.

Thus, carrier 22B comprises a bottom panel 27B having two adjacent side edges 34B and 36B with side panels 32B and 35B hingedly extending from those side edges respectively, and a top panel 28B with its own side panel 40B hingedly extending from a side edge 42B of panel 28B, all as described before. However, in this embodiment, top panel 28B hingedly extends from an opposite side edge 80 of panel 35B, rather than from side edge 38B of side panel 32B. Adhesive on surface 50B permanently secures side panel 40B to side panel 32B when folded as before, creating a rigid corner at 24B when the parts are folded into place, as before.

The invention has been described in detail with particular reference to preferred embodiments thereof, but it will be understood that variations and modifications can be effected within the spirit and scope of the invention. For example, although other features can be added besides those described, it is also useful free of any other features. That is, it can consist of only the enumerated parts.

What is claimed is:

1. In a film package for delivery of film sheets as d stack, comprising a stack of photographic film sheets, a protective carrier partially surrounding said stack, and a light-tight flexible wrapping around said carrier and said stack, the improvement wherein said carrier comprises a bottom panel, first and second side panels hingedly and integrally attached to adjacent side edges of said bottom panel, and a top panel extending from an edge of one of said side panels and permanently secured to the other of said side panels to define a secured exterior corner, said top panel having dimensions such that it leaves exposed a portion of any film sheets and said bottom panel under said top panel, and a third side panel extending integrally from said top panel and dimensioned to overlap a portion of said other side panel, securing means being disposed between said third side panel and said other side panel, so that the permanent securing of said top panel to said other side panel rigidifies said carrier sufficiently to reduce collapsing of said carrier during removal of said flexible wrapping.

2. A film package as defined in claim 1, and further including a third side panel extending integrally from said top panel and dimensioned to overlap a portion of said other side panel.

3. A film package as defined in claim 1, wherein said carrier comprises two portions, one of which includes said bottom, first and second side, and top panels, the other of which comprises a second bottom panel and a second top panel of greater surface area than said one portion bottom and top panels, respectively, said second bottom and top panels being joined to a side panel dimensioned to allow said other portion of said carrier to fit within said exterior corner of said one portion.

4. A film package as defined in claim 3, and further including adhesive disposed between said one and said other portions to permanently secure them together.

* * * * *